United States Patent [19]

Neff

[11] Patent Number: 4,862,961

[45] Date of Patent: Sep. 5, 1989

[54] RETRIEVABLE TENSION-SET PACKER

[75] Inventor: Cecil L. Neff, Olney, Ill.

[73] Assignee: N.A.R.K. Properties, Olney, Ill.

[21] Appl. No.: 204,296

[22] Filed: Jun. 9, 1988

[51] Int. Cl.[4] ..... E21B 23/06

[52] U.S. Cl. ..... 166/127; 166/138; 166/140; 166/196; 166/119

[58] Field of Search ..... 166/138, 139, 140, 127, 166/191, 196, 119

[56] References Cited

U.S. PATENT DOCUMENTS

| | | | |
|---|---|---|---|
| 2,755,864 | 7/1956 | Vaughn | 166/139 |
| 2,806,532 | 9/1957 | Baker et al. | 166/127 X |
| 2,979,132 | 4/1961 | Taylor et al. | 166/138 |
| 2,989,122 | 6/1961 | Kenneday | 166/138 X |
| 3,987,847 | 10/1976 | Craig et al. | 166/191 |
| 4,576,230 | 3/1986 | Tapp et al. | 166/138 X |
| 4,690,220 | 9/1987 | Braddick | 166/138 X |

*Primary Examiner*—Stephen J. Novosad
*Attorney, Agent, or Firm*—Paul M. Denk

[57] ABSTRACT

A retrievable tension-set packer, by itself, and in conjunction with retrievable tension-set bridge plug for use in field testing of oil well casings is disclosed. The retrievable tension-set packer is constructed to be set and sealed above an area of the oil well casing to be tested, while the retrievable tension-set bridge plug is constructed to be set and sealed in an area below the area of the casing to be tested. When used in conjunction with a retrievable tension-set bridge plug, the retrievable tension-set packer has a portion thereof which allows limited rotational movement for setting the bridge plug below the area to be tested, while the tension-set packer requires greater predetermined rotational movement to set the packer above the area to be tested. After the bridge plug is set below the area to be tested, the tension-set packer may be moved upwardly to an area above the area to be tested, in order to selectively isolate the area to be tested through the positive seals established by the bridge plug and packer. Following testing, the packer can be re-assembled to the bridge plug for subsequent repositioning in a different area of the oil well casing, and following complete testing, both the bridge plug and packer may be completely retrieved from the oil well casing.

14 Claims, 2 Drawing Sheets

RETRIEVABLE TENSION-SET PACKER

BACKGROUND OF THE INVENTION

The present invention relates to a retrievable tension-set packer used by itself, or in conjunction with a retrievable tension-set bridge plug, for field testing of oil well casings.

As is well known in the oil field industry, underground oil well casings are subjected to integrity testing in selectively isolated zones or sealed off areas for a variety of activities including acidizing, fracturing, squeeze cementing, or for other testing purposes. These types of activities are generally conducted through separate tubing that is lowered down within the oil well casing. It is therefore, essential and necessary that a pressure tight seal be made at displaced locations within the casing, above and below the area to be tested, such as a casing fracture or perforation point, in order that the desired activity can be adequately performed.

In order to establish a sealed off area below the selectively isolated zone in the oil well casing, one typical construction that was used for approximately twenty years, is the cup-type, pressure-set, retrievable bridge plug, which is manufactured by Elder Oil Tools, Incorporated of Yorktown, Tex. This particular type of bridge plug employs a pair of upwardly and downwardly spaced sealing cups which, when located in position within the oil casing, and either activated under pressure or by rotation, provide compression of the sealing cups, in order to bias them against the inner wall of the casing, and thereby provide a sealed location, generally at the lower end of the selectively isolated zone to be tested. Because of the corroded, pitted or, otherwise deteriorated inner wall surface of the casing, this earlier style of bridge plug had inherent problems in that the sealing cups have not generally provided an effective seal. As a result, leakage occurs because the pressure cannot be retained, and therefore, the testing in the selectively isolated zone can not be effectively accomplished. The Environmental Protection Agency of the U.S. government has also issued regulations allowing only a 10% loss of pressure in the selectively isolated zone within a thirty minute period Due to the aforementioned deterioration of the casing in many wells, this type of tool is unable to create the necessary pressure seal to successfully complete EPA testing.

In order to seal off the casing above the selectively isolated zone to be tested, generally a retrievable weight-set or tension-set packer could generally only be employed in rather deep wells because of the necessity of requiring approximately eight thousand pounds of pressure, through the weight of the tubing within the well, in order to achieve compression of elastomeric rings or components against the internal wall surface of the casing, for setting the packer in the desired location above the selectively isolated zone to be tested. While weight-set or tension-set packers, made operative by the heavy weight of tubing within the oil well casing, are effective for deep wells, i.e., those over 3,000 feet in depth, they are generally not capable of being used in a shallow well, that is. those that extend downwardly to approximately 1500 feet, but generally no lower than 3,000 feet.

In order to satisfy the new EPA regulations for integrity testing of well casings, a new tension set retrievable bridge plug has been developed by Arrow Oil Tools, of Tulsa, Oklahoma, which is a tension-set, packer-type retrievable bridge plug that uses mechanical operation from the surface to set the bridge plug in the desired sealed location below the selectively isolated zone to be tested. These newly developed bridge plugs require either a one-quarter turn left-hand set and right-hand release, or a one-quarter turn right-hand set and left-hand release. In order to be used in conjunction with the newly developed retrievable tension-set bridge plug, a retrievable tension-set packer that is used above the selectively isolated zone to be tested, must likewise be tension-set and released by the one-quarter left or right-hand turn as aforesaid. Thus, while it may be possible to use the retrievable bridge plug and retrievable packer together in setting and re-positioning of the aforementioned units at various positions along the oil well casing, there is little possibility, with existing designs, for any variation in the displacement between these two components, which makes it almost impossible to achieve the proper setting of the bridge plug and packer at locations above and below the area to be tested. In addition, while they are capable of cooperative movement and re-positioning together as a unit within the oil well casing, they are not capable of cooperative removal. Hence, the only way to remove one or both of these components from the casing, after the testing has been completed, is to ream them out or otherwise destroy them through other well drilling components or instrumentation.

The aforementioned one-quarter turn setting/release of the packer and bridge plug combination is accomplished through the use of a bayonet lock design, employing a pair of pins in cooperating elements which fit into inverted and aligned J-shaped slots, such that the pins, when within the J-slots lock the cooperating elements within the oil well casing, and when removed from the J-slots, release the cooperating elements from the oil well casing. As can be appreciated, this requires simultaneous functioning of the packer and bridge plug, which does not afford the independent setting and movement of the packer and bridge plug above and below the selectively isolated zone to be tested.

SUMMARY OF THE INVENTION

Among the several objects and features of this invention may be noted:

The provision of a retrievable tension-set packer for use in oil well casings of any depth, and particularly in shallow well casings.

The provision of such a retrievable tension-set packer which provides a positive seal of the packer at a precise location in order to position the packer in the necessary location above a fracture point or perforation point within the casing, in order to achieve proper and effective testing within the selective isolated zone therebelow;

The provision of a retrievable tension-set packer which meets EPA regulations allowing only 10% loss of pressure in the sealed off area within a thirty minute period;

The provision of a retrievable tension-set packer which may be used by itself, or in conjunction with a retrievable tension-set bridge plug, in order to provide testing at various depths in an oil well casing in a selectively isolated zone, providing release and subsequent re-positioning of the packer and bridge plug in other precise locations within the oil well casing for testing thereof, as well as removal and retrieval of both the packer and bridge plug from the oil well casing following testing;

The provision of a retrievable tension-set packer which may be set in either shallow or deep wells, without the need for excessive mechanical force and weight provided by long lengths of tubing extending in excessive lengths within the casing; and The provision of such a retrievable tension-set packer itself or in conjunction with a retrievable tension-set bridge plug which is highly efficient, is independently operable, is easy to install and operate within oil well casings, is relatively economical, allows for re-positioning, reuse and retrieval of the components numerous times, is adaptable to a wide range of oil well depths, and is otherwise well adapted for the purposes intended.

Briefly stated, the retrievable tension-set packer of the present invention may be used by itself or in conjunction with a retrievable tension-set bridge plug in the field testing of oil well casings. The retrievable tension-set packer employs an elongated tubular body having a lower end which is adapted for use in releasable engagement relative to a retrievable tension-set bridge plug in order to set the bridge plug at a predetermined level along an inner wall of the casing while permitting subsequent removal thereof following testing. The elongated tubular body further has an upper end adapted for engagement relative to an innerconnected string of tubing which extends in the casing upwardly therefrom to the ground surface. An upper packer member is threadably mounted on the elongated tubular body and includes resilient fingers which impart a laterally outwardly directed force against the inner wall of the casing sufficient to permit unthreading of the upper packer member from the elongated tubular body after predetermined rotation of the elongated tubular body relative to the upper member. A lower packer member is also mounted on the elongated tubular body and is actually shifted by the elongated tubular body into engagement with the upper packer member upon threaded disengagement of the upper packer member relative to the elongated tubular body. The lower packer member has a wedging section which engages cooperating wedging surfaces on the resilient fingers to cause aggressive impingement of the resilient fingers against the inner wall of the casing and prevent any longitudinal movement of the upper packer member relative to the elongated tubular body. The lower packer member is further provided with a laterally expandable circumferential seal which is expanded against the inner wall of the casing as the upper and lower packer members are moved into wedging engagement relative to one another for positively sealing the tension-set packer assembly to the internal wall of the casing, for the field testing that is desired. The upper packer member further is provided with circumferentially expandable thread locking segments which permit the aforementioned rotary threaded disengagement from the elongated tubular body, while also being circumferentially expandable when the cooperating complementary threads on the elongated tubular body are longitudinally forced past the circumferentially expandable thread locking segments, in re-assembling the upper packer member into threaded engagement with the elongated tubular body for subsequent retrieval of the tension-set packer. In conjunction therewith, a retrievable tension-set bridge plug may be provided which is set by predetermined rotational movement of the elongated tubular body less than the predetermined rotational movement necessary to unthread the upper packer member from the elongated tubular body. Thus, the packer and bridge plug may be independently positioned at desired locations above and below the fracture or perforation point in the casing, permit subsequent re-assembly of these components for repositioning them at other locations within the oil well casing, and following testing, enabling complete removal or retrieval of the packer and bridge plug from the oil well casing.

Other objects and features of this invention will become apparent from the ensuing description.

DESCRIPTION OF THE PREFERRED EMBODIMENT

Figure 1:
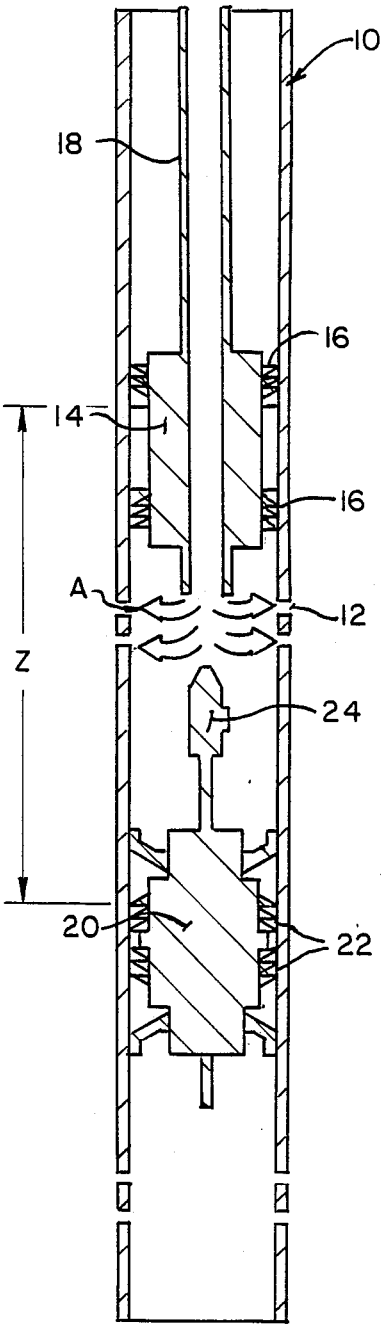
FIG. 1. PRIOR ART.
FIG. 1 is a schematic illustration showing an upper packer member and a lower bridge plug member which are independently set and positioned on opposite sides of a fracture or perforation point in an oil well casing, and showing the manner in which fluids, as represented by the arrows, may be introduced through the tubing extending from the upper packer member into the selectively localized area to be tested, for a variety of purposes as set forth above.

The FIG. 1 "Prior Art" schematic illustration shows an oil well casing 10 having a fracture or perforation point 12 resulting from corrosion or other physical deterioration of the casing 10. Above the fracture or perforation point 12, there is provided an upper packer member 14 which circumferentially supports sealing members 16 that are compressed against the inner wall of the casing 10 to create a positive seal between the casing 10 and an interconnected string of tubing generally identified at 18 which is connected to the upper end of the packer 14, by any suitable method. Below the fracture or perforation point 12, a lower packer member or bridge plug 20 is provided carrying circumferential sealing elements 22 which seal off the casing 10 from the area therebelow to provide a selected isolated zone Z on opposite sides of the fracture or perforation point 12 between the upper and lower sealing elements 16, 22, respectively. The arrows A represent fluid that is conveyed by the tubing 18 from the ground surface to the selected isolated zone Z for performing such activities as acidizing, fracturing, squeeze cementing, or other testing, as may be desired.

The bridge plug 20 further includes an upwardly extending stub 24 which has suitable interconnecting means (not shown) for interconnection with the upper packer member 14, for positioning the upper packer 14 and the lower bridge plug 20 in selected positions on opposite sides of the fracture or perforation point 12. However, in actual commercial practice prior to this invention, while it has been possible to simultaneously place both components into location on opposite sides of a fracture or perforation point, it has been almost impossible to achieve independent setting at locations above and below the casing perforation point, in order to seal off the desired selected isolated zone, to be tested. Furthermore, the upper and lower packers or components are not capable of being cooperatively removed from the casing. Hence, the only way to remove one or both of the packers or components from the casing, after testing has occurred, is to ream them out, or otherwise destroy them through other well drilling components or instrumentation.

Thus, prior to the present invention, there has been no way to selectively and independently position the upper and lower packer and bridge plug components on opposite sides of a fracture or perforation point in the casing, thereafter enable subsequent interconnection of these components for repositioning and re-testing at other fracture or perforation points in the casing, and following testing, permitting cooperative removal of both packers or components.

Figure 2:
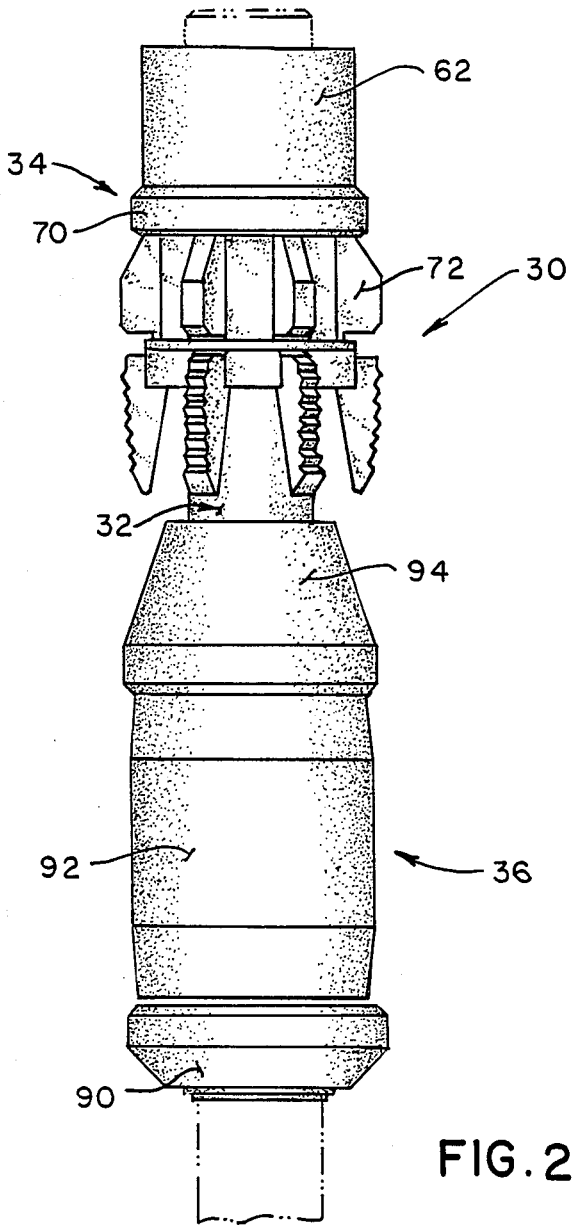
FIG. 2 is a front elevational view of the retrievable tension-set packer which is constructed in accordance with the teachings of the present invention, prior to engagement with the inner wall of an oil well casing.

Accordingly, reference is now made to FIGS. 2 through 6 of the drawings which show, in conjunction with the following description, how the present invention is constructed to achieve the aforementioned features and objects of the present invention. In FIG. 2 of the drawings, a retrievable tension-set packer 30 is shown as including an elongated tubular body 32 having an upper packer member 34 positioned upwardly from a lower packer member 36. It is to be understood that the retrievable tension-set packer 30 corresponds to the the upper packer member 14 in the FIG. 1 prior art illustration, and that any type and construction of retrievable bridge plug 20 may be associated with the retrievable tension-set packer 30, corresponding to the bridge plug 20 in the FIG. 1 "Prior Art" illustration.

Figure 3:
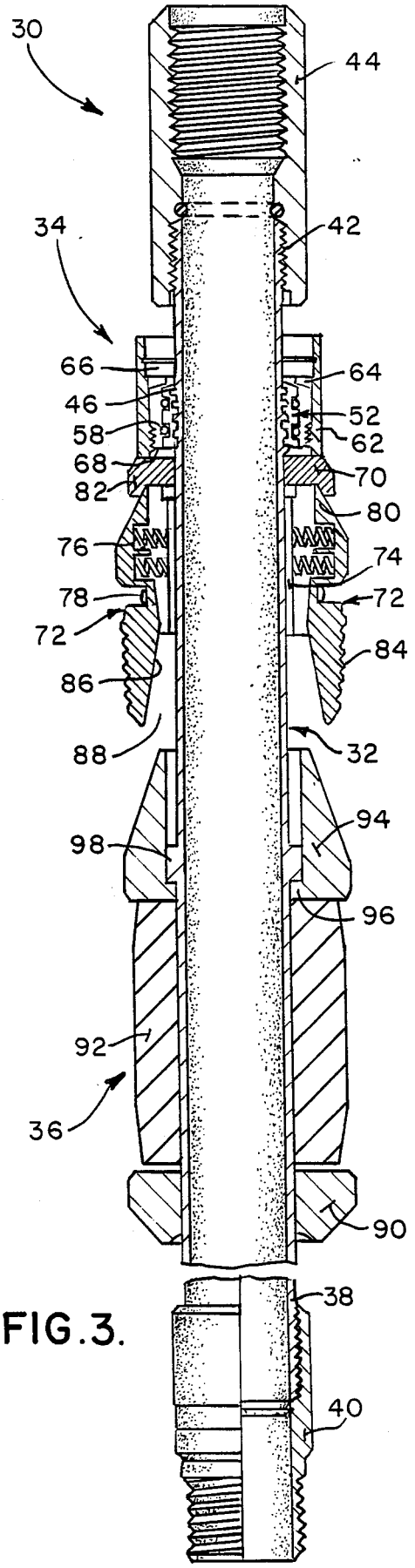
FIG. 3 is a front elevational view, partly in section, illustrating the elements, components and assemblies of the retrievable tension-set packer of the present invention.

As best seen in FIG. 3 of the drawings, the elongated tubular body 32 has a lower end 38, which may be threadably connected to an externally threaded pipe coupling 40 for direct or indirect connection to a retrievable tension-set bridge plug (not shown) below the fracture or perforation point in the casing. A new tension-set retrievable bridge plug has been developed by said Elder Oil Tools, to satisfy Environmental Protection Agency regulations for integrity testing of the well casing. This new bridge plug is a tension-set, packer-type, retrievable bridge plug which is set by using mechanical force from the surface. This bridge plug is tension-set against an inner wall of the well casing by limited rotational movement together with upward movement of a string of tubing, in order to set the bridge plug below the area to be tested. The limited rotational movement necessary to set the plug is approximately one-quarter turn in either direction, with subsequent release of the bridge plug requiring one-quarter turn in the opposite direction from which it was initially set. While this new tension-set retrievable bridge plug (not shown) forms no part of the present invention which is primarily directed to a retrievable tension-set packer 30, it will be seen from the description that follows that the bridge plug and packer components can be independently and selectively positioned on opposite sides of a casing fracture or perforation point, and thus the externally threaded coupling 40 at the lower end 38 of the elongated tubular body 32 provides coupling means, in the form of the external threads, for coupling and un-coupling a bridge plug from association relative to the retrievable tension-set packer 34.

An upper threaded end 42 of the elongated tubular body is complementary and threadably associated relative to an upper internally threaded pipe coupling 44 to which an interconnected string of tubing generally identified 18 as in FIG. 1 of the drawings, may be connected for selectively positioning and rotatably operating the retrievable tension-set packer 34, in a manner now to be described.

A tension-set packer assembly is mounted on the elongated tubular body 32 and includes an upper packer member 34 which is threadably mounted on the elongated body 32 and a lower packer member 36 which is capable of limited back seal or longitudinal movement in one direction, to enable compression and lateral expansion of a component of the lower packing member 36 as will be seen.

Figure 6:
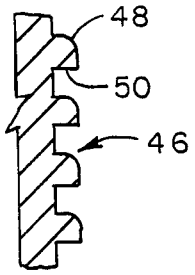
FIG. 6 is a fragmentary sectional view illustrating the thread configuration used with the circumferentially expandable thread locking segments for the retrievable tension-set packer of the present invention.
Figure 5:
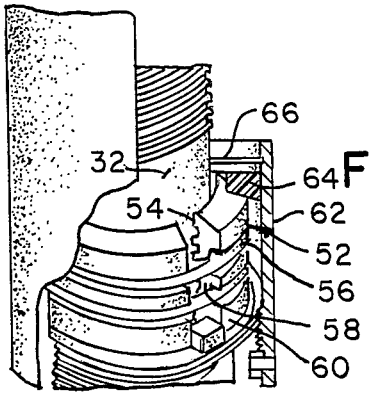
FIG. 5 is a fragmentary isometric view illustrating the circumferentially expandable thread locking segments of the retrievable packer of the present invention.

External threads 46 are formed on the tubular body 32 adjacent to the upper end 42 thereof, but positioned therebelow, as shown in FIG. 3 of the drawings. The configuration of the threads 46 are best shown in FIG. 6 of the drawings, and include an upper camming surface 48 and a lower horizontally extending surface 50 along the spiral extent of the threads 46, for purposes which will be described hereinafter.

The upper packer member 34 includes circumferentially expandable thread locking segments 52 which have a complementary internally threaded accurately shaped internal surface 54 for threaded and mating engagement with the external threads 46 of the body 32. There are a plurality of locking segments 52 which are spaced apart, at a predetermined distance, such as by the spacer 56, and which further are circumferentially retained together by the garter springs 56 received in grooves 58 formed in an outer arcuate surface 60 of the thread locking segments 52. Each of the thread locking segments 52 are circumferentially retained by the garter springs 56, and are also longitudinally restrained within the housing 62 by a nylon bearing or the like 64 at the upper end thereof which is held in place by the snap locking ring 66 mounted to the housing 62, and by lower bearing support 68 which is positioned adjacent the lower end of the housing 62 by the annular stop ring 70. Thus, the thread locking segments 52 are axially restrained for cooperative threaded engagement with the threads 46 so as to permit rotary disengagement thereof as will be subsequently explained, and further permit natural expansion of the locking segments 52, when moved downwardly over the camming surfaces 48 of the threads 46 during the re-assembly, as will also be subsequently explained.

Below the annular stop ring 70 are a plurality of circumferentially spaced resilient fingers 72 which are resiliently urged away from the elongated tubular body 32 by the torsional springs 76 positioned between the resilient fingers 72 and an annular ring or cage element 74 assembled to the elongated tubular body 32. An annular retaining ring 78 holds the plurality of flexible fingers 72 together as a unit below the torsional springs 76. An upper end 80 of the flexible fingers 72 is received and supported within the depending rim 82 of the annular stop ring 70, to maintain the flexible fingers in the general vertical orientation as shown in FIG. 3 of the drawings Outer faces of the resilient fingers 72 have outer, ridged gripping surfaces 84 for engaging the inner wall of the casing. On an opposite side of the ridged gripping surfaces 84, the resilient fingers 72, on an interior surface thereof extend downwardly and outwardly away from the tubular elongated body 32 as at 86, in order to provide, along with the other resilient fingers 72, an interior space 88 which is an interior frusto-conically shaped interior space 88, for purposes to be described.

In addition to the upper packer member 34, the tension-set packer assembly includes the lower packer member 36 which is mounted on the elongated tubular body 32 and is axially shifted into and from engagement relative to the upper packer member 34. Specifically, the lower packer member 36 includes a lower generally annularly-shaped element 90 which is fixed to the elongated tubular body 32, an intermediate rubber tube or packing element 92 which rests upon the annularly shaped element 90, and an upper frusto-conically shaped wedging section 94 which is attached to the rubber tube or packing element 92 at the upper end thereof and movable along therewith. It will be noted that the outer exterior surface of the wedging section 94 has a complementary frusto-conical shape which corresponds with the frusto-conically shaped interior space 88 space formed within the flexible fingers 72, at the lower end thereof The wedging section 94 further has a lower inner shoulder 96 which engages a stop or shoulder 98 on the elongated tubular body 32 to limit, upward movement relative thereto, but permits lower axial movement of the wedging section 94 relative to the rubber tube or packing element 92, in order to compress and laterally expand same against the interior wall of the casing.

Figure 4:
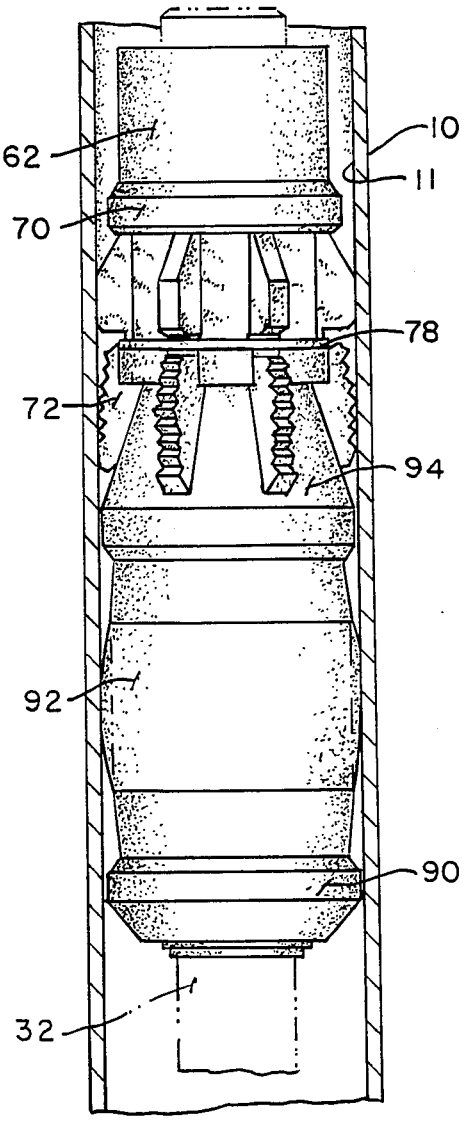
FIG. 4 is fragmentary front elevational view of the retrievable tension-set packer of the present invention, with the components and elements thereof interengaging one another and expanding against the inner wall of an oil well casing.

The above-described components, elements and assemblies of the retrievable tension-set packer 30 operate in conjunction with one another as will be best understood in referring to FIGS. 3–6 of the drawings. The resilient fingers 72 are constructed to initially impart a laterally outwardly directed resilient force against the inner wall of the casing 10 which is sufficient to permit unthreading of the upper packer member 34 from the elongated tubular body 32. It is expected that approximately three complete turns of the upper packer member 34 will permit the circumferentially expandable thread locking segments 52 to be threadably disengaged from the complementary external threads 46 provided on the elongated tubular body 32. When threaded disengagement is thus complete, the elongated tubular body 32 may be axially shifted relative to the upper packer member 34 bringing the wedging section 94 into cooperative engagement with the complementary interior space 88, and causing the wedging section 94 to be forced against the interior walls 86 of the resilient fingers 72, for aggressive impingement of the resilient fingers 72 on the inner wall 11 of the casing. This action prevents any further longitudinal movement of the upper packer member 34 relative to the elongated tubular body 32. However, the rubber tube or packing element 92 is compressed between the wedging section 94 and the fixed ring 90, as the wedging section 94 is moved axially downwardly by the aggressive impingement of the resilient fingers 72 on the inner wall 11 of the casing 10. The rubber tube or packing element 92 is laterally expanded against the inner wall 11 of the casing 10 and provides a circumferential seal thereabout, as shown in FIG. 4 of the drawings, as the upper and lower packing members 34, 36 are moved into wedging engagement relative to one another. Following testing, the upper packer member 34, including the circumferentially expandable thread locking segments 52, may be longitudinally forced past the cooperating complementary threads 46 provided on the elongated tubular body 32, as a result of the circumferential expansion permitted by the garter springs 56 and the camming engagement with the upper camming surfaces 48 of the threaded section 46. In this way, the upper packer member 34 is re-assembled into threaded engagement with the elongated tubular body 32 for subsequent re-positioning and/or retrieval of the tension-set packer 30.

The retrievable tension-set packer 30 is constructed to operate in conjunction with a suitable retrievable tension-set bridge plug (not shown in FIG. 3, but represented at 22 in FIG. 1) in a manner now to be described. As has been discussed in connection with the FIG. 1 "Prior Art" illustration, bridge plugs, such as at 20, are constructed to be set below an area of the oil well casing to be tested. For this purpose, the lower end 38 of the elongated tubular body 32 of the tension-set packer 30 has a threaded coupling 40 extending downwardly therefrom for suitable association with a retrievable tension-set packer (not specifically shown). Such retrievable tension-set bridge plugs (not shown) are constructed for tension setting of the bridge plug against an inner wall 11 of the casing 10 by limited rotational movement (approximately one-quarter turn) together with upward movement of the string of tubing, to set the bridge plug below the area to be tested. With the retrievable tension-set bridge plug threadably associated relative to the threaded coupling 40, the aforementioned limited rotational movement together with upward movement of a string of tubing 18, may be imparted to the retrievable tension-set bridge plug (not shown). This limited rotational and upward movement sets the bridge plug against the inner wall 11 of the casing and separates a solid extension rod or the like (not shown) from the bridge plug This extension rod or the like (not shown) may have its upper end threadably associated with the generally threaded pipe coupling 40 of the retrievable tension-set packer 30, allowing the tension-set packer 30 to be selectively and independently positioned from the bridge plug above the fracture or perforation point 12 in the casing 10, according to the operation of the retrievable tension-set packer 30 described above.

Following testing of the casing 10 at a selected position, the retrievable tension-set packer 30 may thereafter be axially shifted for re-association with the retrievable tension-set bridge plug (not shown). As the upper and lower packer member 34, 36 respectively are disengaged from one another as described above, the upper and lower packer members 34, 36 respectively reassume the position shown in FIG. 3 of the drawing on the elongated tubular body 32. This enables the elongated tubular body 32, together with the pipe coupling 40 to be axially shifted downwardly enabling the rod extension or the like of the bridge plug (not shown) to become re-associated and re-assembled to the tension-set packer 30 by reverse axial shifting and rotational movement (approximately one-quarter turn) relative to the retrievable tension-set bridge plug. Thereafter, the retrievable tension-set packer 30 and the retrievable tension-set bridge plug (not shown) may be moved in conjunction with one another for further activities or testing f the oil well casing 10 at various levels. When testing is complete, both units, assembled together in the aforementioned manner, can then be extracted or retrieved from the oil well casing.

From the above, it can be seen that retrievable tension-set packer by itself, and in conjunction with a retrievable tension-set bridge plug, provides advantageous results over prior art constructions, and further achieves the objects of this invention.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A retrievable tension-set packer for use with a retrievable tension-set bridge plug in the field testing of oil well casings, said retrievable tension-set packer comprising:

an elongated tubular body having a lower end adapted for use in releasable engagement relative to said retrievable tension-set bridge plug in order to set said retrievable tension-set bridge plug at a predetermined level along an inner wall of said casing and for subsequent retrieval thereof following testing, said elongated tubular body having an upper end adapted for engagement relative to an interconnected string of tubing extending in the casing upwardly therefrom;

a tension-set packer assembly mounted on said elongated tubular body between the upper and lower ends thereof and including:

an upper packer member threadably mounted on said elongated tubular body and having resilient fingers imparting a laterally outwardly directed force against the inner wall of said casing which is sufficient to permit unthreading of said upper packer member from said elongated tubular body after predetermined rotation of said elongated tubular body relative to said upper packer member;

a lower packer member mounted on said elongated tubular body and being axially shifted by said elongated tubular body into engagement with said upper packer member upon threaded disengagement of said upper packer member relative to said elongated tubular body, said lower packer member having a wedging section for engaging cooperating wedging surfaces on said resilient fingers to cause aggressive impingement of said resilient fingers on the inner wall of said casing and prevent any longitudinal movement of said upper packer member relative to said elongated tubular body, said lower packer member further being provided with a laterally expandable circumferential seal which is expanded against the inner wall of said casing as said upper and lower packer members are moved into wedging engagement for positively sealing said tension-set packer assembly to the internal wall of said casing in order to field test said casing between a retrievable tension-set bridge plug and said tension-set packer assembly; and said upper packer member further being provided with circumferentially expandable thread locking segments permitting the aforementioned rotary threaded disengagement from said elongated tubular body while also being circumferentially expandable when the cooperating complementary threads on said elongated tubular body are longitudinally forced past the circumferentially expandable thread locking segments in re-assembling the upper packer member into threaded engagement with the said elongated tubular body for subsequent retrieval of said tension-set packer.

2. The packer as defined in claim 1 wherein said resilient fingers are resiliently urged away from said elongated tubular body by springs interposed therebetween.

3. The packer as defined in claim 2 wherein said resilient fingers have outer ridged gripping surfaces for engaging the inner wall of said casing.

4. The packer as defined in claim 3 wherein said resilient fingers extend downwardly and outwardly away from said elongated tubular body at a distance spaced from said aforementioned springs, and said wedging section provided on said lower packer member has a complementary configuration which is received by said downwardly and outwardly extending portion of said resilient fingers to provide wedging engagement therebetween.

5. The packer as defined in claim 4 wherein said downwardly and outwardly extending portions of said flexible fingers and said wedging section have complementary frusto-conical configurations.

6. The packer as defined in claim 5 wherein said second packer member includes a lower generally annularly-shaped element fixed to said elongated tubular body, an intermediate rubber tube element resting upon said annularly-shaped element, and an upper frusto-conical wedging section attached to said rubber tube element and movable along therewith, said lower annularly-shaped element and upper frusto-conical wedging section compressing the intermediate rubber tube element therebetween as the upper frusto-conical wedging section is forced into wedging engagement with the downwardly and outwardly extending portion of said resilient fingers.

7. The packer as defined in claim 6 wherein said circumferentially expandable thread locking segments comprise circumferentially spaced and accurately-shaped thread locking segments having an inner threaded surface, and garter springs received in a groove formed in an outer arcuate surface of said thread locking segments for holding said thread locking segments together while permitting limited circumferential expansion thereof.

8. The packer as defined in claim 7 wherein said garter spring mounted thread locking segments are retained within a housing by upper and lower inwardly directed shoulders provided in said housing for limiting axial movement of said thread locking segments.

9. The packer as defined in claim 8 wherein the internal threads of said thread locking segments have an upper camming surface and a lower horizontally extending surface along the spiral extent thereof.

10. The packer as defined in claim 8 wherein said housing and said resilient fingers are attached to opposite sides of a generally annularly-shaped ring mounted on said elongated tubular body and interposed therebetween.

11. The packer as defined in claim 1 and including a retrievable tension-set bridge plug in combination therewith, said retrievable tension-set bridge plug being set by predetermined rotational movement of said elongated tubular body which is less than the predetermined rotational movement necessary to unthread the upper packer member from the elongated tubular body.

12. A retrievable tension-set packer and a retrievable tension-set bridge plug assembled together and used in field testing of oil well casings, said retrievable tension-set bridge plug constructed to be set below an area of the oil well casing to be tested and being associated with a lower end of said retrievable tension-set packer, said retrievable tension-set packer being constructed to be set above an area of the oil well casing to be tested and having an upper end associated with an interconnected string of tubing extending in the casing upwardly therefrom to the ground surface;

said retrievable tension-set bridge plug including means for tension-setting said bridge plug against an inner wall of said casing by limited rotational movement together with upward movement of said string of tubing to set said bridge plug below said area to be tested, said means further including coupling means for uncoupling said bridge plug from its association with said retrievable tension-set packer;

said retrievable tension-set packer including means for tension-setting of said packer against the inner wall of said casing by predetermined rotational movement greater than the limited rotational movement necessary to set the bridge plug and for uncoupling the packer into two packer members for subsequent axial movement and inter-engagement with one another, said retrievable tension-set packer further including means for establishing a positive seal between the inner wall of said casing and the string of tubing upon subsequent axial movement and inter-engagement of said two packer members;

said retrievable tension-set packer following testing disengaging said two packer members upon reverse axial and rotational movement thereof for releasing said retrievable tension-set packer from the inner wall of said casing, said retrievable tension-set packer being thereafter axially shiftable for re-association with said retrievable tension-set bridge plug;

said retrievable tension-set bridge plug re-coupled to said retrievable tension-set packer by said coupling means upon reverse axial and rotational movement thereof and also being released thereby from the inner wall of said casing;

whereby said retrievable tension-set packer and retrievable tension-set bridge plug are re-assembled together for subsequent re-positioning and use in a different area of said oil well casing, or for removal therefrom.

13. The apparatus as defined in claim 12 wherein said limited rotational movement for setting and subsequent removal of said bridge plug against the inner wall of said casing requires approximately one-quarter of a turn of said bridge plug in opposite directions.

14. The apparatus as defined in claim 13 wherein said predetermined rotational movement for uncoupling the two packer members and for subsequently re-coupling said two packer members as a unit requires approximately three turns in opposite directions.

* * * * *